US011029018B2

(12) United States Patent
Uriarte et al.

(10) Patent No.: US 11,029,018 B2
(45) Date of Patent: Jun. 8, 2021

(54) DIFFUSER VENT RETROFITTED INTEGRATED LIGHTING

(71) Applicant: CARDINAL IP HOLDING, LLC, Milwaukee, WI (US)

(72) Inventors: Anthony Steven Uriarte, Muskegon, MI (US); Peter Michael Schmitz, Byron Center, MI (US)

(73) Assignee: Cardinal IP Holding, LLC, Milwaukee, WI (US)

( * ) Notice: Subject to any disclaimer, the term of this patent is extended or adjusted under 35 U.S.C. 154(b) by 0 days.

(21) Appl. No.: 16/509,816

(22) Filed: Jul. 12, 2019

(65) Prior Publication Data

US 2020/0355364 A1 Nov. 12, 2020

Related U.S. Application Data

(60) Provisional application No. 62/844,477, filed on May 7, 2019.

(51) Int. Cl.

| | |
|---|---|
| ***F21V 33/00*** | (2006.01) |
| ***F21V 21/096*** | (2006.01) |
| ***F21V 23/04*** | (2006.01) |
| ***F21V 23/00*** | (2015.01) |
| ***F21S 9/02*** | (2006.01) |
| ***F21S 8/02*** | (2006.01) |
| ***G08B 13/22*** | (2006.01) |
| *F21Y 115/10* | (2016.01) |

(52) U.S. Cl.

CPC ..... *F21V 33/0088* (2013.01); *F21S 8/022* (2013.01); *F21S 9/02* (2013.01); *F21V 21/096* (2013.01); *F21V 23/003* (2013.01); *F21V 23/0471* (2013.01); *G08B 13/22* (2013.01); *F21Y 2115/10* (2016.08)

(58) Field of Classification Search

None

See application file for complete search history.

(56) References Cited

U.S. PATENT DOCUMENTS

| | | | | |
|---|---|---|---|---|
| 6,418,778 | B1 * | 7/2002 | Shiau | G01N 33/007 204/425 |
| 6,692,349 | B1 * | 2/2004 | Brinkerhoff | F24F 7/00 454/256 |
| 10,001,288 | B1 * | 6/2018 | Yang | F24F 11/62 |
| 2004/0182096 | A1 * | 9/2004 | Alles | F24F 3/0442 62/186 |
| 2007/0091591 | A1 * | 4/2007 | Shamshoian | F24F 13/078 362/147 |

(Continued)

FOREIGN PATENT DOCUMENTS

| | | | | |
|---|---|---|---|---|
| EP | EP-0805313 | A2 * | 11/1997 | F24F 13/06 |

*Primary Examiner* — Chico A Foxx

(74) *Attorney, Agent, or Firm* — Warner Norcross + Judd LLP

(57) ABSTRACT

Aspects of the present disclosure include an integrated lighting system including a casing configured to detachably couple from a conventional air vent, a motion sensor configured to detect a presence of a person, a light source, and a processor configured to receive, from the motion sensor, an indication in response to the motion sensor detecting the presence of the person, and send, to the light source, an activation signal to activate the light source in response to receiving the indication.

20 Claims, 6 Drawing Sheets

(56) References Cited

U.S. PATENT DOCUMENTS

| | | | | |
|---|---|---|---|---|
| 2007/0273539 | A1* | 11/2007 | Gananathan | H05B 47/175 340/615 |
| 2008/0007418 | A1* | 1/2008 | Maki | G09F 27/00 340/686.6 |
| 2008/0204258 | A1* | 8/2008 | Dayton | F21V 33/00 340/600 |
| 2011/0122603 | A1* | 5/2011 | Shamshoian | E04B 9/02 362/149 |
| 2011/0270446 | A1* | 11/2011 | Scharf | F24F 13/1426 700/282 |
| 2014/0354179 | A1* | 12/2014 | Newton | H05B 45/10 315/297 |
| 2016/0173746 | A1* | 6/2016 | Chien | F21V 23/04 348/159 |
| 2016/0327252 | A1* | 11/2016 | Ray | F21V 29/74 |
| 2017/0105129 | A1* | 4/2017 | Teplin | H04L 41/0806 |
| 2018/0084926 | A1* | 3/2018 | Watanabe | F25D 17/045 |
| 2018/0231271 | A1* | 8/2018 | Najafi | F24F 13/1426 |
| 2018/0320869 | A1* | 11/2018 | Yu | F21V 21/096 |
| 2019/0186714 | A1* | 6/2019 | Bergman | F21S 4/28 |
| 2020/0069833 | A1* | 3/2020 | Petrov | A61L 9/122 |
| 2020/0244805 | A1* | 7/2020 | Philbin | G08B 25/016 |
| 2020/0256544 | A1* | 8/2020 | Ray | F21V 23/007 |

* cited by examiner

DIFFUSER VENT RETROFITTED INTEGRATED LIGHTING

CROSS-REFERENCE TO RELATED APPLICATIONS

The current application claims priority to U.S. Provisional Application No. 62/844,477, filed on May 7, 2019, entitled "Diffuser Vent Retrofitted Integrated Lighting," the contents of which are incorporated by reference in their entireties.

BACKGROUND

Conventional air vents may be dispersed throughout a structure. The locations of the conventional air vent may be suitable for providing illumination when an area around the air vent is dark. Illumination at night may provide mood lighting or added safeties (e.g., providing illumination to allow a person to avoid tripping over objects) and/or securities (e.g., detects or deters intruders). Although some conventional vents (e.g., bathroom fans) provide illumination, such vents are purchased with a built-in illumination system. Such vents are not designed to receive a retro-fitted illumination system. In addition, such vents require an outlet or separate electrical line to power such devices. Therefore, improvements in providing integrated lighting to conventional air vents may be desirable.

SUMMARY

This summary is provided to introduce a selection of concepts in a simplified form that are further described below in the DETAILED DESCRIPTION. This summary is not intended to identify key features of the claimed subject matter, nor is it intended to be used as an aid in determining the scope of the claimed subject matter.

An aspect of the present disclosure includes an integrated lighting system including a casing configured to detacheably couple from a conventional air vent, a motion sensor configured to detect a presence of a person, a light source, and a processor configured to receive, from the motion sensor, an indication in response to the motion sensor detecting the presence of the person, and send, to the light source, an activation signal to activate the light source in response to receiving the indication.

Some aspects of the present disclosure includes an air vent including a louver and a retro-fitted integrated lighting system having a casing configured to detacheably couple from a conventional air vent, a motion sensor configured to detect a presence of a person, a light source, and a processor configured to receive, from the motion sensor, an indication in response to the motion sensor detecting the presence of the person, and send, to the light source, an activation signal to activate the light source in response to receiving the indication.

BRIEF DESCRIPTION OF THE DRAWINGS

The features believed to be characteristic of aspects of the disclosure are set forth in the appended claims. In the description that follows, like parts are marked throughout the specification and drawings with the same numerals, respectively. The drawing figures are not necessarily drawn to scale and certain figures may be shown in exaggerated or generalized form in the interest of clarity and conciseness. The disclosure itself, however, as well as a preferred mode of use, further objects and advantages thereof, will be best understood by reference to the following detailed description of illustrative aspects of the disclosure when read in conjunction with the accompanying drawings, wherein:

DETAILED DESCRIPTION

The following includes definitions of selected terms employed herein. The definitions include various examples and/or forms of components that fall within the scope of a term and that may be used for implementation. The examples are not intended to be limiting.

The term "processor," as used herein, can refer to a device that processes signals and performs general computing and arithmetic functions. Signals processed by the processor can include digital signals, data signals, computer instructions, processor instructions, messages, a bit, a bit stream, or other computing that can be received, transmitted and/or detected. A processor, for example, can include microprocessors, microcontrollers, digital signal processors (DSPs), field programmable gate arrays (FPGAs), programmable logic devices (PLDs), state machines, gated logic, discrete hardware circuits, and other suitable hardware configured to perform the various functionality described herein.

The term "bus," as used herein, can refer to an interconnected architecture that is operably connected to transfer data between computer components within a singular or multiple systems. The bus can be a memory bus, a memory controller, a peripheral bus, an external bus, a crossbar switch, and/or a local bus, among others.

The term "memory," as used herein, can include volatile memory and/or nonvolatile memory. Non-volatile memory can include, for example, ROM (read only memory), PROM (programmable read only memory), EPROM (erasable PROM) and EEPROM (electrically erasable PROM). Volatile memory can include, for example, RAM (random access memory), synchronous RAM (SRAM), dynamic RAM (DRAM), synchronous DRAM (SDRAM), double data rate SDRAM (DDR SDRAM), and direct RAM bus RAM (DRRAM).

The term "operable connection," as used herein, can include a connection by which entities are "operably connected", is one in which signals, physical communications, and/or logical communications can be sent and/or received. An operable connection can include a physical interface, a data interface and/or an electrical interface.

Figure 1:
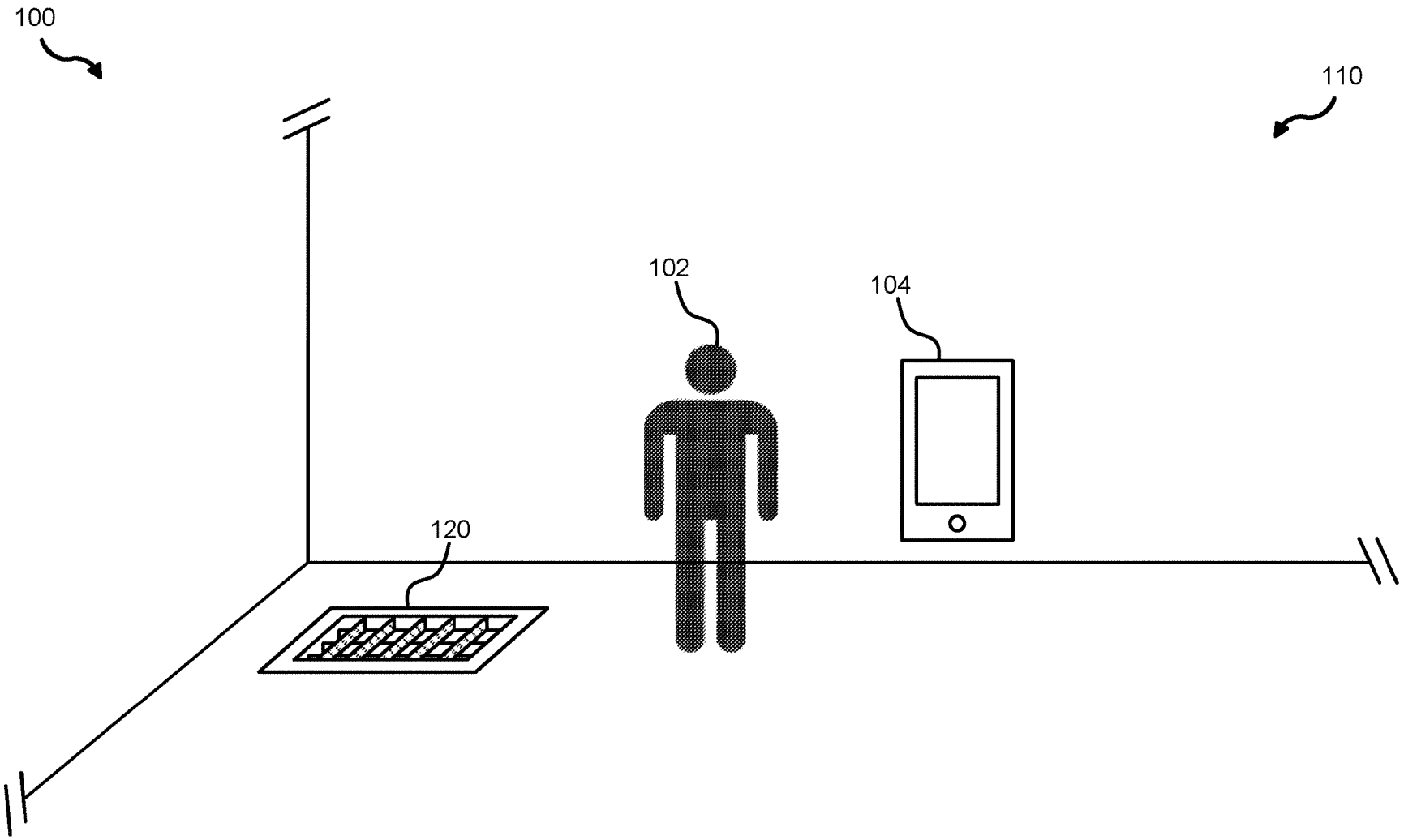
FIG. 1 illustrates an example of an environment for retrofitting conventional air vents with integrated lighting in accordance with aspects of the present disclosure.
Figure 2:
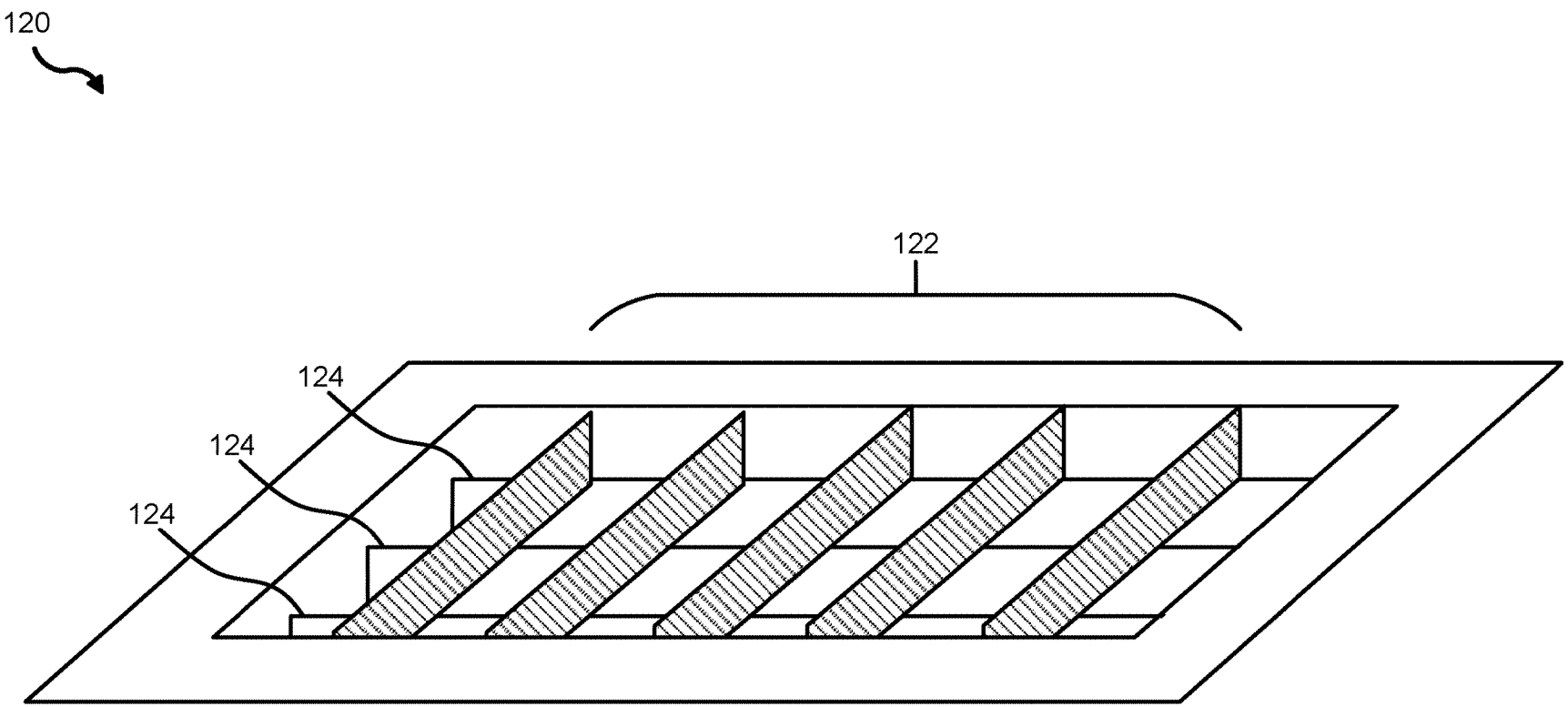
FIG. 2 illustrates a conventional air vent.

FIG. 1 shows an air vent 120 installed in the floor. The air vent 120 can be installed in a floor, wall or ceiling. A person 102 using a handheld device 104 can use the handheld device to interact with the air vent 120. The handheld device 104 may include a wireless device, a mobile phone, a cellular phone, a tablet computer, a personal digital assistant, a smartphone, or other portable devices capable of wireless communications. The handheld device 104 may be implemented as a computer system (example shown below). The environment 100 may include a room 110 including a conventional air vent 120. As shown in FIG. 2, the conventional air vent 120 may include a first set of louvers 122 and a second set of louvers 124. The first set of louvers 122 may be stationary or adjustable. For example, each louver of the first set of louvers 122 may be individually adjustable. The second set of louvers 124 may be stationary or adjustable. For example, each louver of the second set of louvers 124 may be individually adjustable.

Figure 3:
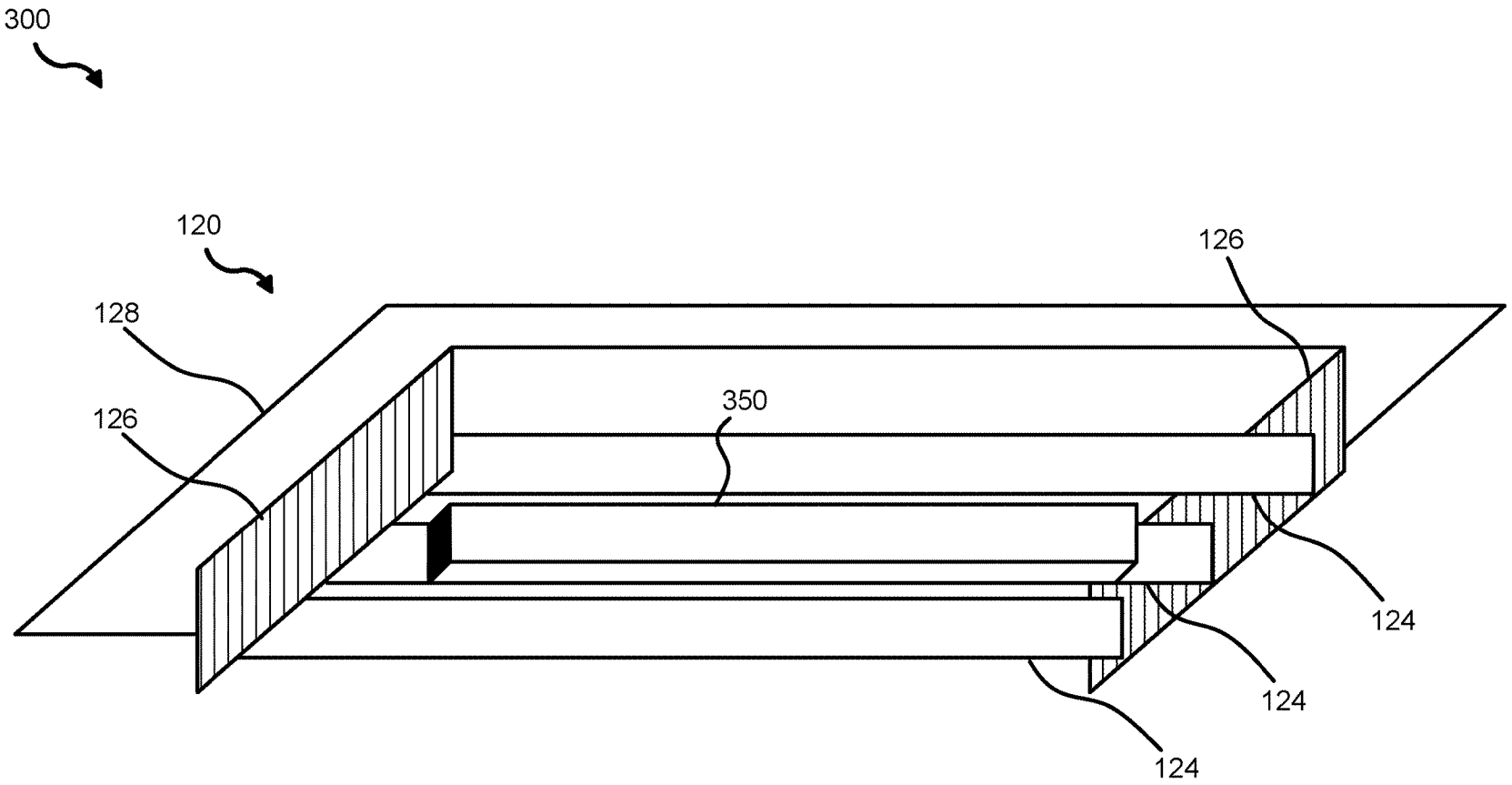
FIG. 3 illustrates a conventional air vent with an example of a retrofitted integrated lighting in accordance with aspects of the present disclosure.

Turning now to FIG. 3, in some implementations, an example of the conventional air vent 120 retrofitted with integrated lighting may include the conventional air vent 120 having the first set of louvers 122 (removed for clarity), the second set of louvers 124, one or more brackets 126, and a surface 128. The second set of louvers 124 may be rotatably coupled with the one or more brackets 126. The second set of louvers 124 may be rotated into a first position parallel to the surface 128 to substantially obstruct air flow through the conventional air vent 120 and into a second position perpendicular to the first position to allow air flow through the conventional air vent 120.

In some implementations, the conventional air vent 120 may be retrofitted with an integrated lighting system 350. The integrated lighting system 350 may be detacheably coupled with the conventional air vent 120. For example, the integrated lighting system 350 may be coupled with one of the second set of louvers 124 using an adhesive, such as glue, cement, paste, epoxy, adhesive tapes, double sided tapes or other known adhesives for coupling the integrated lighting system 350 with one of the second set of louvers. In another example, the integrated lighting system 350 may be coupled with one of the second set of louvers 124 using one or more internal or external magnets. The one or more internal/external magnets may be disposed on one or more sides of the integrated lighting system 350. The one or more internal magnets may magnetically couple with one of the second set of louvers 124. In yet another non-limiting example, the integrated lighting system 350 may be coupled with one of the second set of louvers 124 using one or more fasteners such as bolts, screws, nails, buckles, buttons, ties, clamps, clasps, clips, pins, hooks, latches, pegs, rings, rivets, anchors, staples, or straps. In some aspects of the present disclosure, the integrated lighting system 350 may be coupled with at least one of the one or more brackets 126 using one or more fasteners such as bolts, screws, nails, buckles, buttons, ties, clamps, clasps, clips, pins, hooks, latches, pegs, rings, rivets, anchors, staples, or straps.

In some implementations, the integrated lighting system 350 may include a narrow profile to minimize obstruction to air flow through the conventional vent 120.

Figure 4:
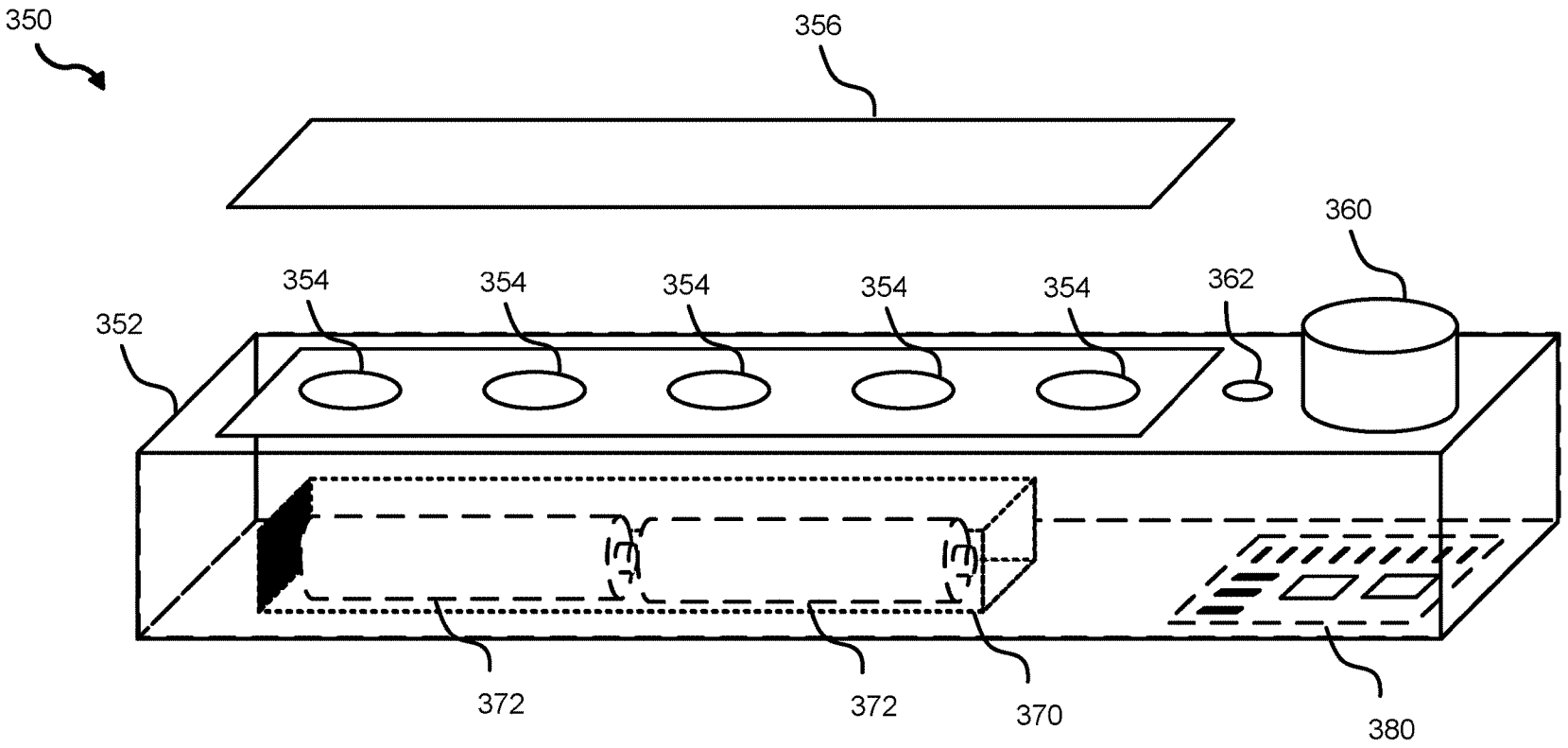
FIG. 4 illustrates an example of a retrofitted integrated lighting in accordance with aspects of the present disclosure

Turning now to FIG. 4, the integrated lighting system 350 may include a casing 352, one or more light emitting diodes 354, a diffuser lens 356, a motion sensor 360, a photodetector 362, a battery compartment 370, and a microcontroller 380. The casing 352 may contain the one or more light emitting diodes 354, the diffuser lens 356, the motion sensor 360, the photodetector 362, the battery compartment 370, the microcontroller 380 and/or other components. The one or more light emitting diodes 354 may include compound semiconductor (e.g., gallium arsenide, gallium arsenide phosphide, gallium phosphide, aluminum gallium arsenide, aluminum gallium nitride, aluminum gallium indium phosphide, aluminum gallium indium nitride, aluminum gallium, aluminum phosphide, aluminum nitride, zinc selenide, indium gallium nitride, indium gallium arsenide, silicon carbide, or other elemental, molecular (e.g., II-VI or III-V compounds)) light emitting diodes and/or organic light emitting diodes. Other lights, such as fluorescent lights or incandescent lights, may also be used. The diffuser lens 356 may include a smoke or acrylic lens for dispersing the light originating from the one or more light emitting diodes 354. The one or more light emitting diodes 354 may be configured to provide mood lighting to the room 110 (e.g., illuminating the one or more light emitting diodes 354 at 5%, 10%, 15%, 20%, 25%, or other partial luminance intensity).

In some implementations, the motion sensor 360 may be a passive infrared (PIR) sensor, a microwave sensor, an ultrasonic sensor, a tomographic motion detector, or a photodetection circuit and/or logic. The motion sensor 360 may measure infrared radiations emitted from objects. The photodetector 362 may include a semiconductor sensor, a photovoltaic sensor, a thermal sensor, a photochemical sensor, or other suitable photo-detection sensors. The photodetector 362 may be configured to detect the intensity of light near the integrated lighting system 350, such as the intensity of light in the room 110. In certain examples, the photodetector 362 may include a detection range of up to 1 foot, 5 feet (ft), 10 ft, 20 ft, 30 ft, 50 ft, 100 ft, 200 ft, 500 ft, 1000 ft, or other ranges.

In some examples, when the photodetector 362 detects the intensity of light to be below a predetermined threshold and the motion sensor 360 detects the presence of the person 102, the microcontroller 380 of the integrated lighting system 350 may activate (e.g., from off to fully on) or increase (e.g., from mood lighting to fully on) the luminance intensity of the one or more light emitting diodes 354. In other examples, when the photodetector 362 detects the intensity of light to be above a predetermined threshold and the motion sensor 360 detects the presence of the person 102, the microcontroller 380 of the integrated lighting system 350 may keep the one or more lighting emitting diodes 354 in the off state.

In some aspects, the integrated lighting system 350 may be powered by one or more batteries 372 stored in a battery compartment 370 of the casing 352. The battery compartment 370 is configured to receive one or more batteries to power the integrated lighting system 350.

In some aspects, the integrated lighting system 350 may be controlled by a microcontroller 380. For example, the microcontroller 380 may include one or more processors, a memory, and/or a communications circuit. The microcontroller may be communicatively coupled with the motion sensor 360 and the one of more light emitting diodes 354. The microcontroller 380 may receive electrical energy from the one or more batteries 372.

During an example of operation, the conventional air vent 120 with the integrated lighting system 350 may be placed in a room, such as the room 110. When the person 102 enters the room 110, the motion sensor 360 may detect the presence of the person 102 (e.g., detecting infrared radiations emitted by the person 102) or an animal. In response to detecting the person 102, the microcontroller 380 of the integrated lighting system 350 may active the one or more light emitting diodes 354 to provide illumination.

In some examples, in response to detecting the person 102, the microcontroller 380 of the integrated lighting system 350 may active the one or more light emitting diodes 354 to provide illumination when the ambience in the room 110 is dark as detected by the photodetector 362 (e.g., late at night).

In some implementations, the motion sensor 360 may be configured such that an animal does not trigger the motion sensor 360. For example, the animal may produce an infrared signature captured by the motion sensor 360. The motion sensor 360 may determine that the signature of the animal is below a predetermined threshold, and may not trigger. The motion sensor 360 may partially or entirely protrude beyond the first set of louvers 122 when the integrated lighting system 350 is coupled with the conventional air vent 120.

In other examples, the integrated lighting system 350 may utilize the communications circuit in the microcontroller 380 to wirelessly communicate with the handheld device 104, or other devices. The communications circuit may include one or more antennas or antenna arrays, transceivers, receivers, transmitters, power amplifiers, low noise amplifiers, and/or modems. When the microcontroller 380 of the integrated lighting system 350 detects the person 102 via the motion sensor 360, the microcontroller 380 of the integrated lighting system 350 may transmit, via the communications circuit, a signal to a receiving device, such as the handheld device 104 or other suitable devices such as an alarm panel, to indicate the detection of the person 102. The signal may include an identifier associated with the conventional air vent 120 and/or the integrated lighting system 350. In an implementation, the microcontroller 380 of the integrated lighting system 350 may transmit, via the communications circuit, a low battery signal to the handheld device 104 indicating the one or more batteries 372 have reached a low battery status.

In another example, the microcontroller 380 of the integrated lighting system 350 may receive, via the communications circuit, configuration information, software update information, intrusion alerts, or other information from the handheld device 104 or other suitable systems.

In some aspects of the present disclosure, the integrated lighting system 350 may be integrated into an alarm system (not shown). For example, the integrated lighting system 350 may function as a stand-alone motion detector monitoring a zone (e.g., the room 110). Upon detecting the person 102 using the motion sensor 360, the microcontroller 380 of the integrated lighting system 350 may transmit (via the communications circuit) an alert signal to a "hub" of the alarm system (e.g., the handheld device 104 or an alarm panel) indicating a potential intrusion. The handheld device 104 or the alarm panel, for example, may alert an authority (e.g., local police, sheriff, on-site security company) of the potential intrusion.

In some implementations, the integrated lighting system 350 may be programmed, by the handheld device 104 and/or an application in the handheld device 104 for example, to activate the motion sensor 360 in response to receiving an activation command from the handheld device 104 or during certain time of the day (e.g., from 9 pm to 7 am). The application may set mood lighting, turn on-off air vents when dark, activate air vents at predetermined times, deactivate air vents at other predetermined times, and alert the authority. The application may be installed on the handheld device 104, a stand-alone computer, and/or dedicated an alarm system such as an alarm panel.

Figure 5:
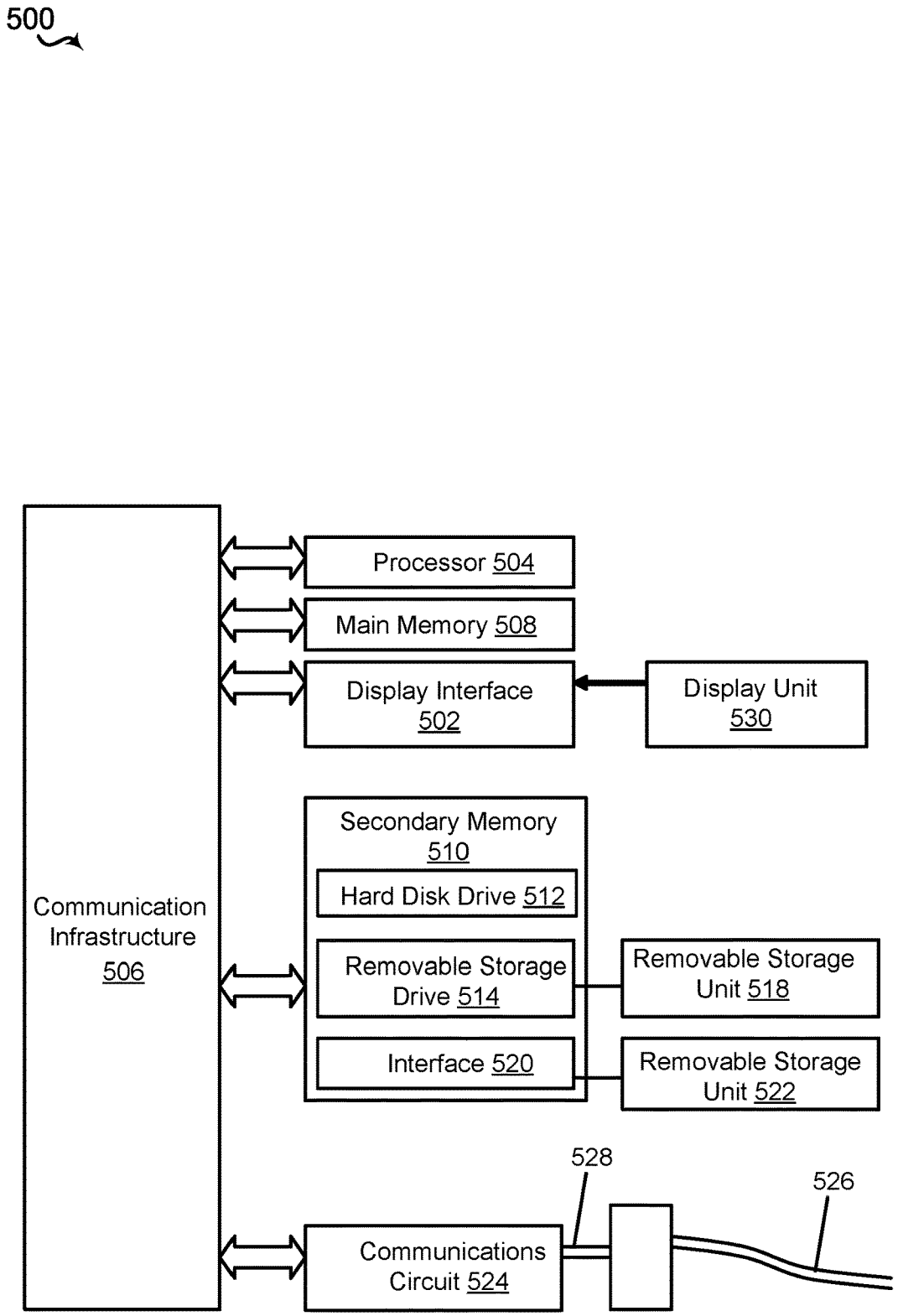
FIG. 5 illustrates an example of a computer system in accordance with aspects of the present disclosure.

Aspects of the present disclosures may be implemented using hardware, software, or a combination thereof and may be implemented in one or more computer systems or other processing systems. In an aspect of the present disclosures, features are directed toward one or more computer systems capable of carrying out the functionality described herein. An example of such the computer system 500 is shown in FIG. 5. In some examples, the handheld device 104 may be implemented as the computer system 500 shown in FIG. 5. The handheld device 104 may include some or all of the components of the computer system 500. In some aspects, the integrated lighting system 350 may be implemented as the computer system 500 shown in FIG. 5. The integrated lighting system 350 may include some or all of the components of the computer system 500.

The computer system 500 includes one or more processors, such as processor 504. The processor 504 is connected with a communication infrastructure 506 (e.g., a communications bus, cross-over bar, or network). Various software aspects are described in terms of this example computer system. After reading this description, it will become apparent to a person skilled in the relevant art(s) how to implement aspects of the disclosures using other computer systems and/or architectures.

The computer system 500 may include a display interface 502 that forwards graphics, text, and other data from the communication infrastructure 506 (or from a frame buffer not shown) for display on a display unit 530. Computer system 500 also includes a main memory 508, preferably random access memory (RAM), and may also include a secondary memory 510. The secondary memory 510 may include, for example, a hard disk drive 512, and/or a removable storage drive 514, representing a floppy disk drive, a magnetic tape drive, an optical disk drive, a universal serial bus (USB) flash drive, etc. The removable storage drive 514 reads from and/or writes to a removable storage unit 518 in a well-known manner. Removable storage unit 518 represents a floppy disk, magnetic tape, optical disk, USB flash drive etc., which is read by and written to removable storage drive 514. As will be appreciated, the removable storage unit 518 includes a computer usable storage medium having stored therein computer software and/or data. In some examples, one or more of the main memory 508, the secondary memory 510, the removable storage unit 518, and/or the removable storage unit 522 may be a non-transitory memory.

Alternative aspects of the present disclosures may include secondary memory 510 and may include other similar devices for allowing computer programs or other instructions to be loaded into computer system 500. Such devices may include, for example, a removable storage unit 522 and an interface 520. Examples of such may include a program cartridge and cartridge interface (such as that found in video game devices), a removable memory chip (such as an erasable programmable read only memory (EPROM), or programmable read only memory (PROM)) and associated socket, and other removable storage units 522 and interfaces 520, which allow software and data to be transferred from the removable storage unit 522 to computer system 500.

Computer system 500 may also include a communications circuit 524. The communications circuit 524 may allow software and data to be transferred between computer system 500 and external devices. Examples of the communications circuit 524 may include a modem, a network interface (such as an Ethernet card), a communications port, a Personal Computer Memory Card International Association (PCMCIA) slot and card, etc. Software and data transferred via the communications circuit 524 are in the form of signals 528, which may be electronic, electromagnetic, optical or other signals capable of being received by the communications circuit 524. These signals 528 are provided to the communications circuit 524 via a communications path (e.g., channel) 526. This path 526 carries signals 528 and may be implemented using wire or cable, fiber optics, a telephone line, a cellular link, an RF link and/or other communications channels. In this document, the terms "computer program medium" and "computer usable medium" are used to refer generally to media such as a removable storage drive 518, a hard disk installed in hard disk drive 512, and signals 528. These computer program products provide software to the computer system 500. Aspects of the present disclosures are directed to such computer program products.

Computer programs (also referred to as computer control logic) are stored in main memory 508 and/or secondary memory 510. Computer programs may also be received via communications circuit 524. Such computer programs, when executed, enable the computer system 500 to perform the features in accordance with aspects of the present disclosures, as discussed herein. In particular, the computer programs, when executed, enable the processor 504 to perform the features in accordance with aspects of the present disclosures. Accordingly, such computer programs represent controllers of the computer system 500.

In an aspect of the present disclosures where the method is implemented using software, the software may be stored in a computer program product and loaded into computer system 500 using removable storage drive 514, hard drive 512, or communications interface 520. The control logic (software), when executed by the processor 504, causes the processor 504 to perform the functions described herein. In another aspect of the present disclosures, the system is implemented primarily in hardware using, for example, hardware components, such as application specific integrated circuits (ASICs). Implementation of the hardware state machine so as to perform the functions described herein will be apparent to persons skilled in the relevant art(s).

In one non-limiting example, the handheld device 104 may be implemented as the computer system 500 having the one or more processor, the main memory 508, the display interface 502, the display unit 530, the communication infrastructure 506, and the communications circuit 524.

In other examples, the integrated lighting system 350 may be implemented as the computer system 500 having the one or more processor, the main memory 508, and the communications circuit 524.

Figure 6:
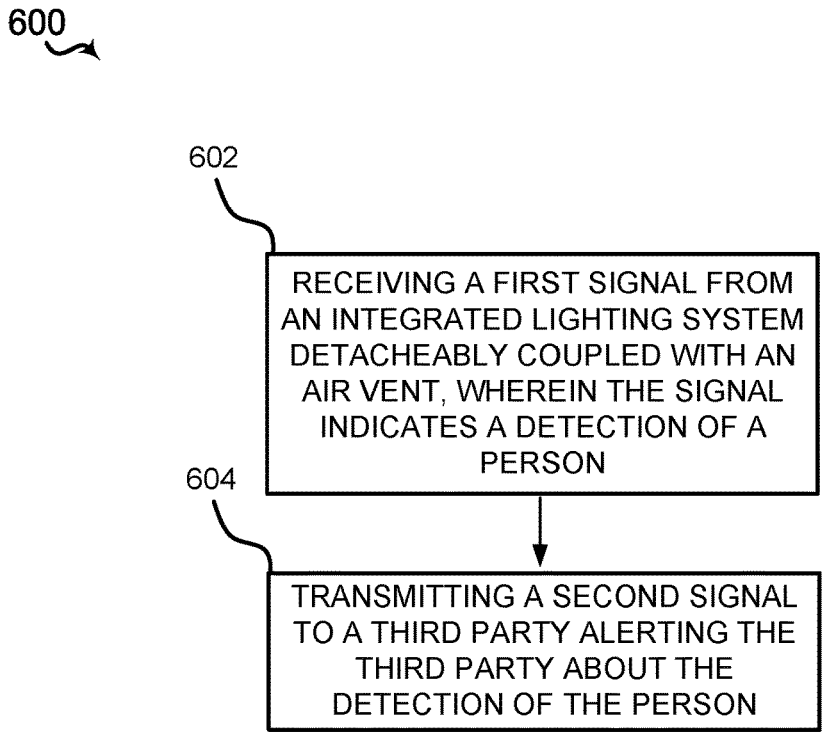
FIG. 6 illustrates a method for reporting a detection in accordance with aspects of the present disclosure.

Turning now to FIG. 6, a method 600 for reporting a detected intrusion may be performed by the handheld device 104.

At block 602, the method 600 may receive a first signal from an integrated lighting system detacheably coupled with an air vent, wherein the signal indicates a detection of a person. For example, the communications circuit (e.g., the communications circuit 524) and/or the processor (e.g., the one or more processors 504) of the handheld device 104 may receive a first signal from the integrated lighting system 350 indicating the detection of the person 102 by the motion sensor 360. The integrated lighting system 350 may be coupled with the conventional air vent 120.

At block 604, the method 600 may transmit a second signal to a third party alerting the third party about the detection of the person. For example, the communications circuit (e.g., the communications circuit 524) and/or the processor (e.g., the one or more processors 504) of the handheld device 104 may transmit a second signal to an authority to alert the authority (e.g., police, sheriff, security, alarm monitoring organization, etc.) about the detection of the person 102. In one example, the handheld device 104 may send an emergency text message to a server of a police station to report an intrusion. In another example, the handheld device 104 may automatically place a call to a sheriff station to report the detection of the person 102. In some examples, the handheld device 104 may send an email to security personnel to alert the security personnel about the detection of the person 102 in the room 110. In yet another example, the handheld device 104 may send a signal to an alarm monitoring company to report the detection of the person 102.

It will be appreciated that various implementations of the above-disclosed and other features and functions, or alternatives or varieties thereof, may be desirably combined into many other different systems or applications. Also that various presently unforeseen or unanticipated alternatives, modifications, variations, or improvements therein may be subsequently made by those skilled in the art which are also intended to be encompassed by the following claims.

What is claimed is:

1. An integrated lighting system, comprising:

a casing configured to detachably couple from a conventional air vent, the air vent including at least one louver, the casing containing lighting system components including:

a motion sensor configured to detect a presence of a person;

a light source; and a processor configured to:

receive, from the motion sensor, an indication in response to the motion sensor detecting the presence of the person, and send, to the light source, an activation signal to activate the light source in response to receiving the indication;

wherein the casing includes at least one coupling mechanism for retrofit detachably coupling the casing as a self-contained unit to a portion of the conventional air vent.

2. The integrated lighting system of claim 1, wherein:

the casing includes one or more magnets; and the casing is magnetically coupled with the conventional air vent via the one or more magnets.

3. The integrated lighting system of claim 1, wherein the casing is configured to couple with the at least one louver of the conventional air vent.

4. The integrated lighting system of claim 1, wherein the motion sensor is mounted on a first surface of the casing and includes a passive infrared sensor, a microwave sensor, an ultrasonic sensor, a tomographic motion detector, or a photodetection circuit.

5. The integrated lighting system of claim 1, further comprising a diffuser lens mounted on the first surface of the casing and overlying the light source for dispersing light emitted from the light source.

6. The integrated lighting system of claim 1, further comprising a battery compartment within the casing for storing one or more batteries used to provide electrical energy to the integrated light system.

7. The integrated lighting system of claim 1, further comprising a photodetector mounted on the first surface of the casing that detects an intensity of light within a detection range of the photodetector.

8. The integrated lighting system of claim 1, further comprising a communications circuit contained within the casing.

9. The integrated lighting system of claim 8, wherein the one or more processors are further configured to transmit, via the communications circuit, a signal to a receiving device remote from the casing in response to detecting the presence of the person.

10. An air vent system, comprising:

a louver; and a self-contained, retrofit integrated lighting system including:

a casing configured to detachably couple from the louver, the casing including a first surface and a second surface, the second surface including at least one coupling mechanism detachably coupled to a portion of the louver as a self-contained unit, the casing containing a series of lighting system components including:

a motion sensor on the first surface, the motion sensor configured to detect a presence of a person;

a light source on the first surface; and a processor within the casing, the processor configured to:

receive, from the motion sensor, an indication in response to the motion sensor detecting the presence of the person, and send, to the light source, an activation signal to activate the light source in response to receiving the indication.

11. The air vent of claim 10, wherein:

the casing includes one or more magnets; and the casing is magnetically coupled with the air vent.

12. The air vent of claim 10, wherein the air vent includes an exterior, room facing surface, and the louver includes a first set of louvers adjacent the surface and a second set of louvers positioned behind the first set of louvers, wherein the coupling mechanism on the casing is configured to couple with a louver of the second set of louvers of the air vent.

13. The air vent of claim 10, wherein the motion sensor includes a passive infrared sensor, a microwave sensor, an ultrasonic sensor, a tomographic motion detector, or a photodetection circuit.

14. The air vent of claim 10, wherein the integrated lighting system further comprises a diffuser lens disposed over the light source for dispersing light emitted from the light source.

15. The air vent of claim 10, wherein the integrated lighting system further comprises a battery compartment contained within the casing for storing one or more batteries used to provide electrical energy to the integrated light system.

16. The air vent of claim 10, wherein the integrated lighting system further comprises a photodetector on the first surface of the casing that detects an intensity of light within a detection range of the photodetector.

17. The air vent of claim 10, wherein the integrated lighting system further comprises a communications circuit.

18. The air vent of claim 17, wherein the one or more processors are further configured to transmit, via the communications circuit, a signal to a receiving device in response to detecting the presence of the person.

19. A method of reporting an intrusion from a handheld device, comprising:

providing a self-contained, retrofit integrated lighting system including a casing, a coupling mechanism on the casing, and a series of lighting system components contained by the casing, the components including a light source, a motion sensor and a processor;

providing an air vent having at least one louver;

attaching the self-contained, retrofit integrated lighting system to the air vent with the coupling mechanism;

receiving a first signal from the integrated lighting system, wherein the signal indicates a detection of a person; and transmitting, in response to receiving the first signal, a second signal to a third party alerting the third party about the detection of the person.

20. The method of claim 19, wherein the third party includes at least one of a police dispatch, a sheriff department, a security center, or an alarm monitoring company.

* * * * *